US008601640B2

(12) United States Patent
Bertram et al.

(10) Patent No.: US 8,601,640 B2
(45) Date of Patent: Dec. 10, 2013

(54) VACUUM CLEANER, ESPECIALLY FLOOR VACUUM CLEANER

(75) Inventors: Andre Bertram, Bielefeld (DE); Volker Gerth, Bielefeld (DE); Olivier Liebig, Bielefeld (DE); Rainer Schultz, Guetersloh (DE); Heiko Stork, Herford (DE); Dirk Wegener, Bielefeld (DE); Manfred Gerhards, Euskirchen (DE)

(73) Assignee: Miele & Cie. KG, Guetersloh (DE)

( * ) Notice: Subject to any disclaimer, the term of this patent is extended or adjusted under 35 U.S.C. 154(b) by 1202 days.

(21) Appl. No.: 12/158,309

(22) PCT Filed: Dec. 13, 2006

(86) PCT No.: PCT/EP2006/011980

§ 371 (c)(1),
(2), (4) Date: Jun. 19, 2008

(87) PCT Pub. No.: WO2007/073864

PCT Pub. Date: Jul. 5, 2007

(65) Prior Publication Data

US 2008/0256742 A1 Oct. 23, 2008

(30) Foreign Application Priority Data

Dec. 19, 2005 (DE) ..... 10 2005 061 040
Dec. 11, 2006 (DE) ..... 10 2006 058 613

(51) Int. Cl.
*A47L 9/28* (2006.01)

(52) U.S. Cl.
USPC ..... 15/327.2; 15/339; 15/412

(58) Field of Classification Search
USPC ..... 15/351, 327.2, 339, 319, 412, DIG. 1; 307/66, 64, 43, 80; 134/21
See application file for complete search history.

(56) References Cited

U.S. PATENT DOCUMENTS

| | | | | |
|---|---|---|---|---|
| 4,835,409 | A | 5/1989 | Bhagwat et al. | |
| 4,969,229 | A * | 11/1990 | Svanberg et al. | 15/339 |
| 5,014,388 | A | 5/1991 | Schiazza et al. | |
| 5,787,545 | A * | 8/1998 | Colens | 15/319 |
| 6,219,880 | B1 | 4/2001 | Worden et al. | |
| 6,448,732 | B1 * | 9/2002 | Block | 318/635 |
| 6,526,622 | B2 * | 3/2003 | Conrad | 15/319 |
| 7,526,833 | B2 * | 5/2009 | Cochran et al. | 15/327.2 |
| 2002/0112315 | A1 | 8/2002 | Conrad | |
| 2002/0121000 | A1 | 9/2002 | Tyler | |
| 2005/0091785 | A1 | 5/2005 | Yuen | |
| 2005/0155177 | A1 | 7/2005 | Baer et al. | |
| 2009/0151114 | A1 * | 6/2009 | Pineschi | 15/412 |

FOREIGN PATENT DOCUMENTS

| | | |
|---|---|---|
| DE | 721908 | 6/1942 |
| DE | 3633783 | 4/1988 |
| DE | 68923365 | 11/1995 |
| DE | 202004018067 | 1/2005 |
| DE | 10 2004 018 793 | 10/2005 |

(Continued)

*Primary Examiner* — Dung Van Nguyen
(74) *Attorney, Agent, or Firm* — Leydig, Voit & Mayer, Ltd.

(57) ABSTRACT

A vacuum cleaner includes a housing, a motor-driven suction fan disposed in the housing, a fan motor and a power supply device configured to provide power supply to the fan motor. The vacuum cleaner also includes both a rechargeable battery and cord reel permanently integrated in the housing such that the vacuum cleaner is configured to be alternately operable in a battery mode and a mains mode.

18 Claims, 4 Drawing Sheets

(56) References Cited

FOREIGN PATENT DOCUMENTS

| | | |
|---|---|---|
| DE | 10 2005 063240 | 7/2006 |
| DE | 102005063240 | 7/2006 |
| EP | 0262514 | 4/1988 |
| EP | 0401531 | 12/1990 |
| EP | 1419723 | 5/2004 |
| JP | 2002034872 | 2/2002 |
| JP | 2003235770 | 8/2003 |
| WO | 2004/041054 | 5/2004 |
| WO | 2005099547 | 10/2005 |

* cited by examiner

VACUUM CLEANER, ESPECIALLY FLOOR VACUUM CLEANER

CROSS REFERENCE TO RELATED APPLICATIONS

This is a U.S. National Phase application under 35 U.S.C. §371 of International Application No. PCT/EP2006/011980, filed on Dec. 13, 2006, and claims the benefit of German Patent Application No. 10 2005 061 040.4, filed on Dec. 19, 2005, and German Patent Application No. 10 2006 058 613.1, filed on Dec. 11, 2006. The International Application was published in German on Jul. 5, 2007 as WO 2007/073864 A1 under PCT Article 221(2).

FIELD

The present invention relates to a vacuum cleaner, in particular a canister vacuum cleaner, including a housing containing a motor-driven suction fan and a device for providing power supply to the fan motor.

BACKGROUND

Canister vacuum cleaners having a mains power supply cord are generally known in the prior art. Such vacuum cleaners have the disadvantage that a mains power outlet must be within their reach to supply power thereto. This is not always the case, especially when cleaning stairs or vehicles, so that extension cords must be used, which reduces the ease-of-use. Also known are vacuum cleaners which can be operated independently of the mains supply. In order to enable said vacuum cleaners to operate in self-contained mode, a power supply module is provided which may contain one or more rechargeable battery cells. European Patent Document EP 0 401 531 B1, for example, describes a vacuum cleaner whose housing has a cavity therein which is externally accessible and used to accommodate a removable battery assembly. The vacuum cleaner disclosed therein has means for removably holding the battery assembly within the cavity. In vacuum cleaners which are powered by non-rechargeable or rechargeable batteries, due to the high power consumption of the suction fan, the energy storage capacity is usually not sufficient to allow thorough cleaning of a large carpet, or of a room having a wall-to-wall carpet, so that the battery must be repeatedly recharged. This also reduces the ease-of-use.

Further, DE 10 2004 018 793 A1 describes an electrical floor-cleaning apparatus having a chamber adapted to receive either a power supply module or a cord reel module. This apparatus allows the decision as to whether the vacuum cleaner is to be produced for mains operation or for battery operation to be taken at a late stage in the manufacturing process, but ultimately the product is a vacuum cleaner that has only one of the two alternative modes of operation and the associated disadvantages. Except for the option of employing either a rechargeable battery or a cord reel, no further adjustments are made. It may therefore be assumed that the fan motor is designed to operate at a mains voltage of 230 volts. In the case of power supply from a rechargeable battery, the operating voltage would be reduced to at least one third of said voltage, as a result of which the maximum power would be reduced to one-ninth compared to that in mains operation. Consequently, satisfactory operation in battery mode would no longer be possible.

SUMMARY

In view of the above, an aspect of the present invention is to provide a vacuum cleaner which permits both mains operation and self-contained operation.

In an embodiment, the present invention provides a vacuum cleaner including a housing, a motor-driven suction fan disposed in the housing, a fan motor and a power supply device configured to provide power supply to the fan motor. The vacuum cleaner also includes both a rechargeable battery and cord reel permanently integrated in the housing. The vacuum cleaner is configured to be operable alternately in a battery mode and a mains mode.

BRIEF DESCRIPTION OF THE DRAWINGS

An exemplary embodiment of the present invention will be described in more detail below and is shown in a schematic way in the drawings, in which.

DETAILED DESCRIPTION

Figure 1:
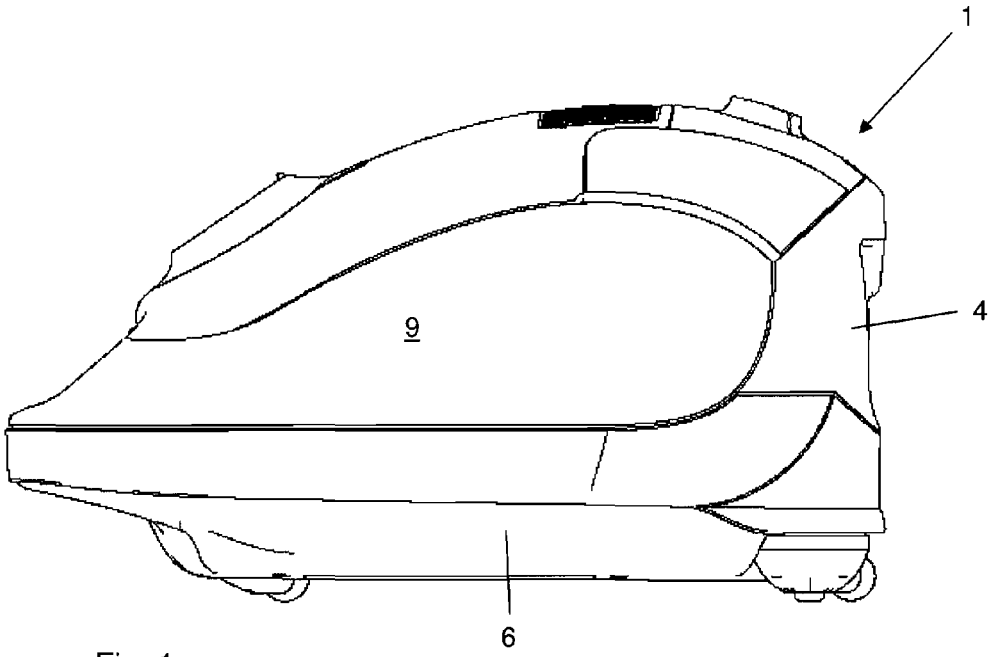
FIG. 1 is a side view of a canister vacuum cleaner.

In an embodiment, the present invention provides a rechargeable battery and a cord reel within the housing as permanently integrated components, allowing the vacuum cleaner to be operated in either a battery or mains mode, as needed. Thus, the user can use the vacuum cleaner as a hybrid vacuum cleaner in both modes of operation without any retrofitting. When operated in mains mode, the vacuum cleaner can be used to full capacity, while in battery mode, it can be rapidly and flexibly used for vacuuming in between times at a somewhat lower, but still acceptable suction power. The latter applies, in particular, to locations which usually are not within reach of a power outlet, such as garden sheds, terraces, stairs or vehicles.

The rechargeable battery can be disposed in a lower shell at the bottom of the housing. In order to fabricate the housing of the hybrid vacuum cleaner, this allows the use of only a modified bottom shell, while all other housing parts can be configured as in conventional, mains-powered vacuum cleaners. Thus, the same tools can be used in the fabrication process, which allows for inexpensive manufacture. In an embodiment, the lower shell can be double-walled and has stiffening ribs. Moreover, a plurality of separate battery cells can be disposed in the lower shell and/or the lower shell can be provided with openings for removal of the rechargeable battery or battery cells.

In an embodiment, the fan motor is a universal motor having a rated voltage between 80 and 120 volts. In this manner, the difference between the maximum adjustable input power of the fan motor in mains mode (about 1200 watts at 110 volts) and that in battery mode (about 600 watts at 65 volts) is kept within acceptable limits. A suitable circuit arrangement is provided to transform the mains voltage to an operating voltage between 50 volts and 100 volts. The voltage produced by the rechargeable battery can be between 50 volts and 80 volts, and in a specific embodiment about 65 volts.

To save the user the effort of switching from mains mode to battery mode, the supply of mains voltage can be sensed by a further circuit arrangement, and if the mode of operation is settable to mains mode when mains voltage is supplied, and to battery mode when there is no voltage supply from the mains.

A method for operating such a vacuum cleaner has the feature that the rechargeable battery can be charged during operation in mains mode, so that the vacuum cleaner can then also be used without a power cord at any time.

In an embodiment of this method, via the further circuit arrangement, the maximum fan power that can be selected for operation in battery mode using a power adjustment device is reduced compared to that for operation in mains mode. This indicates to the user that during battery mode, he/she will not be able to select the full power that is available during operation in mains mode.

In order to prevent a short-circuit, the mains mode and the battery mode can be reliably separated from each other, for example, by a change-over relay.

Figure 2:
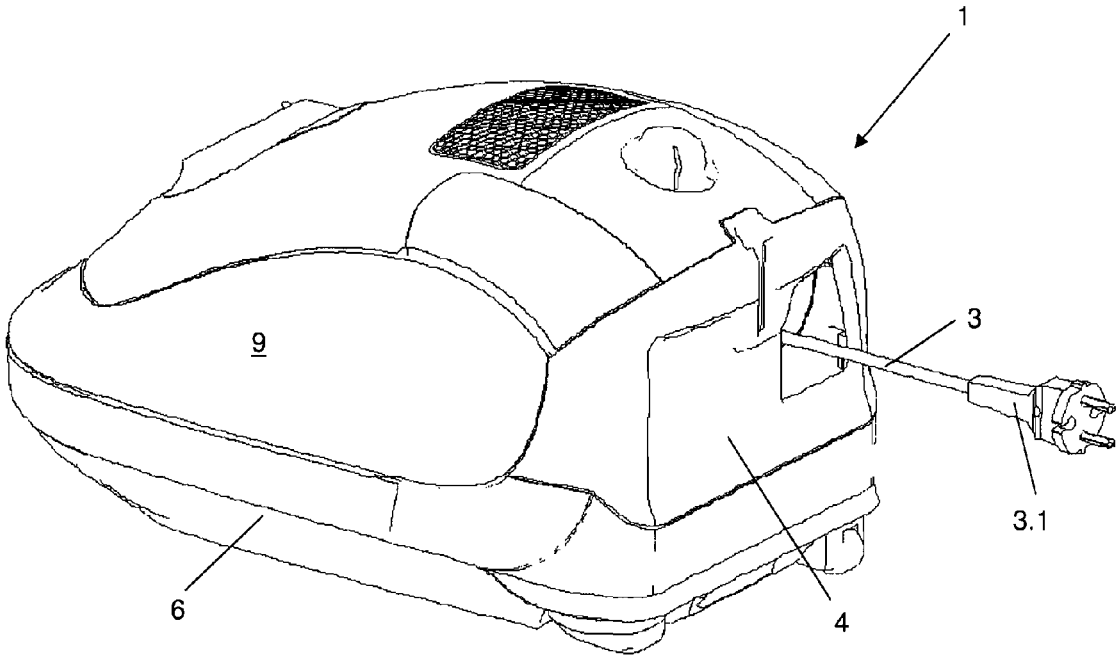
FIG. 2 is a perspective rear view of the canister vacuum cleaner.
Figure 3:
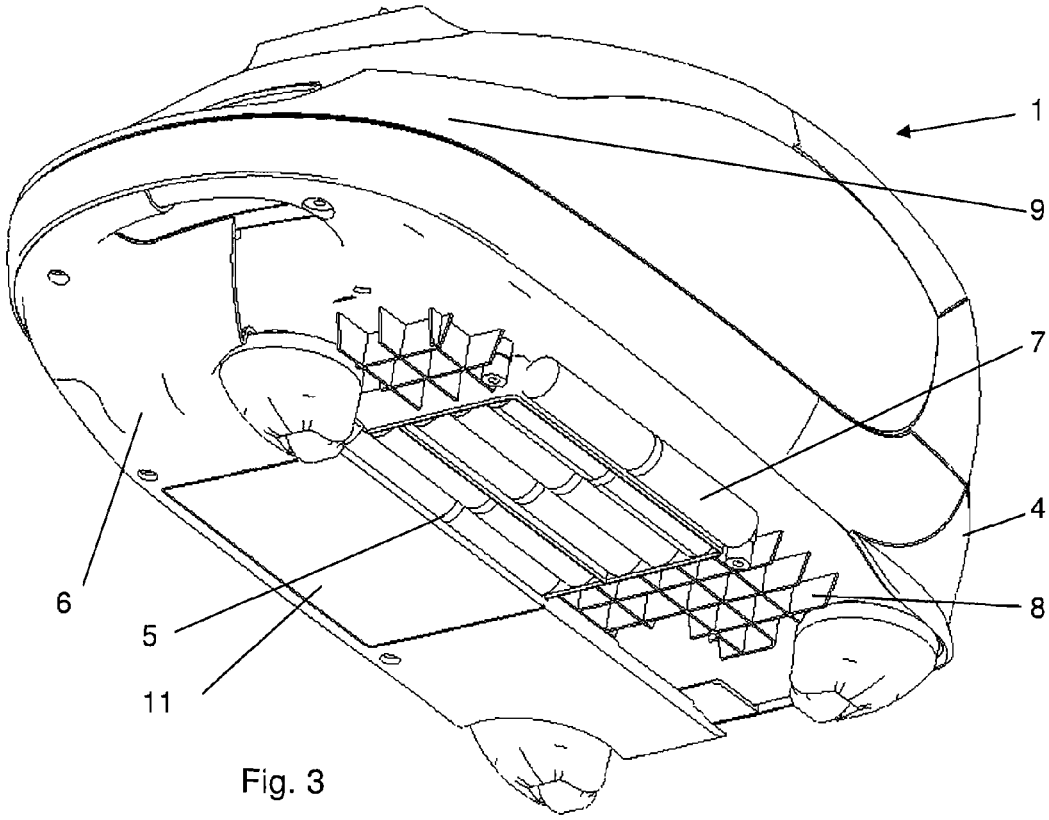
FIG. 3 is a partially cross-sectional bottom view of the canister vacuum cleaner shown in FIG. 1.

FIGS. 1 through 3 show a canister vacuum cleaner 1 which, in accordance with the present invention, is specifically designed as a hybrid vacuum cleaner. A cord reel 2 (see FIG. 6), onto which can be wound a power cord 3, is provided for mains operation. As in other canister vacuum cleaners manufactured and sold by the applicant (see also DE 10 2005 018 908), the aforesaid cord reel is disposed within housing 4 in the right rear end portion thereof. In FIG. 2, the end of power cord 3 that is pulled out of housing 4 is shown along with mains plug 3.1. A rechargeable battery 5 is provided for self-contained operation. Rechargeable battery 5 and cord reel 2 are disposed within vacuum cleaner housing 4 as permanently integrated components.

Figure 4:
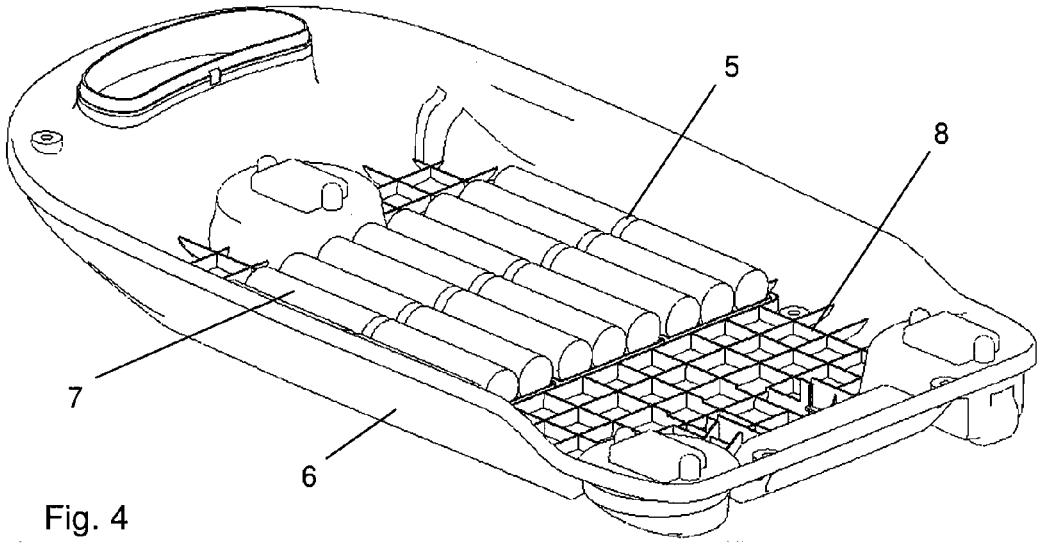
FIG. 4 is an isolated view of the lower shell of the canister vacuum cleaner shown in FIG. 1.

As can be seen from FIGS. 1 and 3, rechargeable battery 5 is disposed in a lower shell 6 at the bottom of housing 4. Lower shell 6 is also shown in the isolated perspective view of FIG. 4. It can be seen in both FIG. 3 and FIG. 4 that rechargeable battery 5 is composed of individual cells 7, which are connected in series to produce an output voltage of about 65 volts. Lower shell 6 is double-walled and has stiffening ribs 8, so that lower shell 6 has sufficient mechanical strength. The lower shell is provided with openings 11 for removal and replacement of battery cells 7.

Battery cells 7 are arranged in the front portion of lower shell 6 below dust chamber 9. This provides the advantage that the air drawn into dust chamber 9 cools the cells 7 during the charging process.

Figure 5:
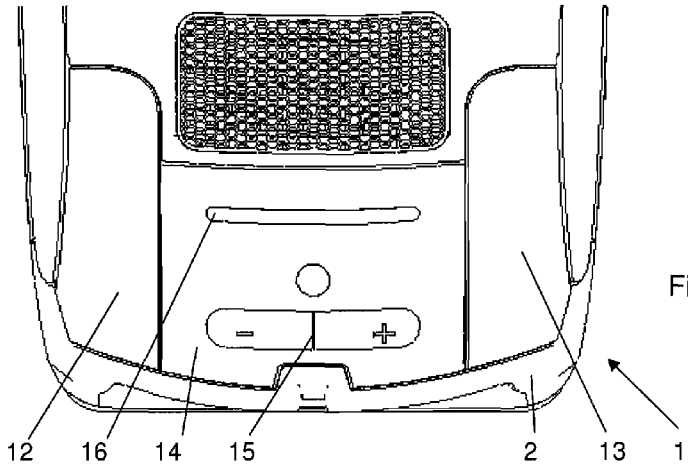
FIG. 5 is a partial top view showing the region of the power control of the canister vacuum cleaner according to the present invention.

FIG. 5 is a top view specifically showing the region of canister vacuum cleaner 1 where a control panel 14 containing a plus/minus button 15 and an associated display 16 is disposed between an ON/OFF button 12 and a button 13 for operating the automatic cord winder. Plus/minus button 15 is used to adjust the power of fan motor 10.

Figure 6:
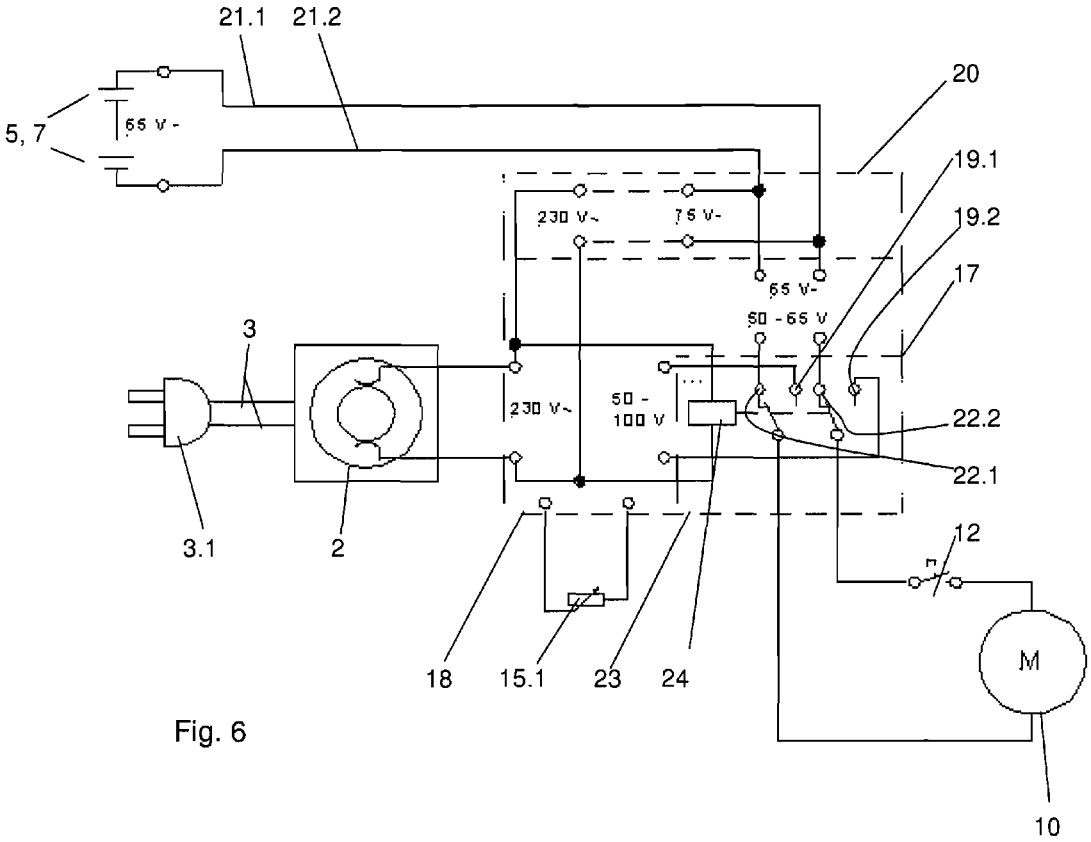
FIG. 6 is a schematic circuit arrangement of the hybrid vacuum cleaner of the present invention.

FIG. 6 shows, in an isolated view, the electrical circuit diagram of the power supply for the hybrid vacuum cleaner 1 described earlier herein. Here, the graphic symbols used for the components that are represented as objects in FIGS. 1 through 5 are denoted by the same reference numerals. In accordance with the present invention, the fan is driven by a universal motor 10 which is capable of operating at a maximum voltage of 100 volts and has a power consumption of about 1200 watts at this voltage. In order to produce this voltage, the mains voltage is passed from the electrically connected mains plug 3.1 via cord reel 2 to a first converter 18, which is incorporated in appliance controller 17. There, the mains voltage of 230 volts is converted by pulse-width modulation to an output voltage between 50 and 100 volts, which is then available at terminals 19.1 and 19.2 of a first voltage output. The final level of the output voltage is dependent on the level set by plus/minus button 15 (symbolized in FIG. 6 by potentiometer 15.1), an output voltage of 100 volts corresponding to an input power of about 1200 watts and a voltage setting of 50 volts corresponding to an input power of about 300 watts. Parallel to this, the mains voltage is stepped down to 75 volts and subsequently rectified by a second converter 20, which is also incorporated in appliance controller 17. This voltage is available in parallel on conductors 21.1 and 21.2, which are routed from rechargeable battery 5 to a second voltage output 22 and via which rechargeable battery 5 is charged when mains plug 3.1 is in a connected position. The output voltage produced by rechargeable battery 5 can similarly be reduced by pulse-width modulation from a maximum of 65 volts (which corresponds to a power of 600 watts) to 50 volts (which corresponds to a power of 300 watts). In the de-energized state, a change-over relay 24 connects fan motor 10 via ON/OFF button 12 to terminals 22.1 and 22.2 of the second voltage output, as illustrated. Thus, voltage supply is provided by rechargeable battery 5. When mains plug 3.1 is in a connected position, change-over relay 24 picks up and connects fan motor 10 to first voltage output 19.1 and 19.2. This causes an automatic switch-over to the mains mode. Relay 24 reliably separates the battery mode form the mains mode in order to prevent a short-circuit. Thus, the relay and voltage outputs 19.1/19.2 and 22.1/22.2 are components of a circuit arrangement which is capable of sensing supply of mains voltage and which allows the mode of operation to be set to mains mode when mains voltage is supplied, and to battery mode when there is no voltage supply from the mains. This circuit arrangement is symbolized by box 23.

Figure 7:
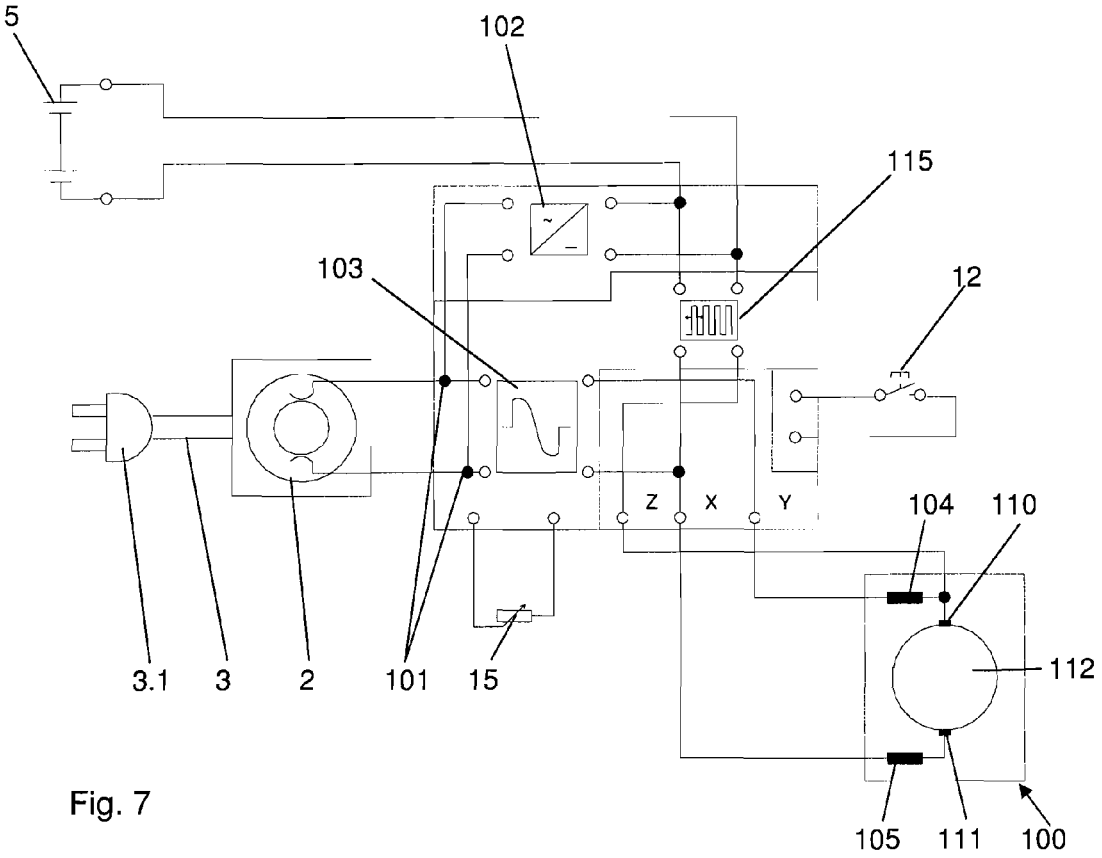
FIG. 7 is a schematic circuit arrangement of another exemplary embodiment of a hybrid vacuum cleaner according to the present invention.

FIG. 7 shows, in an isolated view, the electrical circuit diagram of the power supply for another exemplary embodiment of a hybrid vacuum cleaner 1 as described earlier herein. Here, the graphic symbols used for the components that are represented as objects in FIGS. 1 through 5 are denoted by the same reference numerals. In accordance with the present invention, the fan is driven by a universal motor 100 which is capable of operating at a rated voltage of 230 volts and has a power consumption of about 2000 watts at this voltage. During mains operation, the voltage of 230 volts is passed via cord reel 2 to a junction 101, and from there both to a charging rectifier 102 and to the power adjustment means. In order to enable adjustment of the fan power via plus/minus button 15, a known phase control circuit 103 is used. The voltage so produced is applied to the two terminals X and Y, from where it powers the two halves of a stator winding formed by coils 104 and 105.

Figure 8:
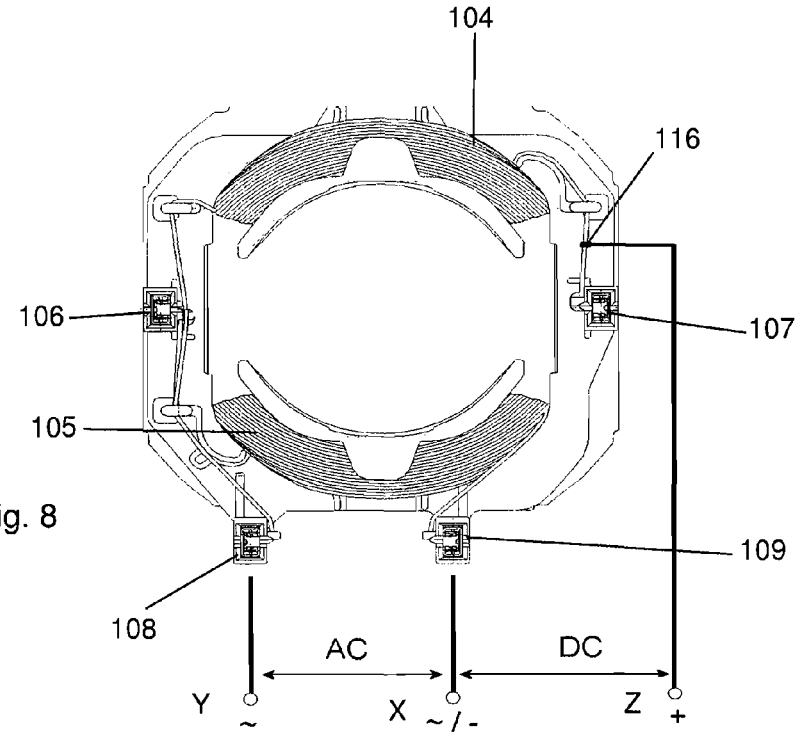
FIG. 8 is a view illustrating the stator winding pack of the fan motor of a hybrid vacuum cleaner as shown in FIG. 7.

FIG. 8 shows the entire stator winding pack, including the two coils 104 and 105 and terminals 106 through 109. The two terminals 106 and 107 provide electrical contact to the winding ends of the two coils 104 and 105 and to additional holders and terminals for carbon brushes 110 and 111, the latter of which are not in FIG. 8, but indicated symbolically in FIG. 7. The armature 112 of the motor is also only symbolically shown in FIG. 7. Terminals 108 and 109 provide electrical contact to the winding ends of the two coils 104 and 105, and are connected to terminals X and Y. Thus, during operation in mains mode, the voltage produced by phase control circuit 103 is applied to the entire coil pack.

The rechargeable battery 5 shown in FIG. 7 produces a voltage of 88 volts. During operation in mains mode, the aforesaid battery is charged via charging rectifier 102. When mains plug 3.1 is in a disconnected position and ON/OFF switch is in the ON position, the battery supplies its voltage to a further power adjustment means, which is configured as a pulse-width modulator 115. Power adjustment is also accomplished by means of plus/minus button 15. The positive output of the pulse-width modulated battery voltage is then connected to terminal Z. It can be seen in FIG. 8 that this terminal Z is connected to a tap 116 which is directly connected to terminal 107 for a carbon brush 110. The negative output of the pulse-width modulated battery voltage is connected to terminal X, and from there via terminal 109 to the end of coil 104. Because carbon brush 110 is connected directly to the positive voltage, and the negative voltage is applied to coil 104, first of all, the polar wear of carbon brushes 110 and 111, i.e., the transfer of carbon ions from the anode to the cathode, is kept low and, secondly, it is only in this way that commutation can be accomplished.

Using the circuit described above, a hybrid vacuum cleaner is created which has the following features:

When the appliance is OFF and mains plug 3.1 is not inserted, vacuum cleaner 1 is unable to perform any functions. When the appliance is OFF and mains plug 3.1 is in a connected position, battery cells 7 are charged. When the appliance is turned on by ON/OFF button 12 and mains plug 3.1 is inserted, battery cells 7 are charged and vacuum cleaner 1 is operating in mains mode. When the appliance is turned on by ON/OFF button 12 and mains plug 3.1 is in a disconnected position, vacuum cleaner 1 is operating only in battery mode. This illustrates the ease-of-use provided by the hybrid vacuum cleaner 1 of the present invention. Thus, the mode of operation in which the hybrid vacuum cleaner 1 of the present invention will operate depends only on whether or not mains plug 3.1 is in a connected position.

Since, due to the low voltage of the rechargeable battery, only a reduced power can be selected, it is advantageous to block or disable the possibility of selecting power levels higher than 600 watts when change-over relay 24 is de-energized. The adjustment of the fan power is done using plus/minus button 15, the respective power level being indicated by an LED (not shown) in display 16. Here, suitable steps would be, for example, from 1200 watts to 900 watts, 600 watts, possibly 450 watts and 300 watts. Thus, during operation in mains mode, the power may then be adjusted via button 15 in a range between 1200 and 300 watts, and more specifically in four steps. Conversely, during operation in battery mode, the power could only be adjusted in two or three steps between 600 and 300 watts. The embodiment according to FIGS. 7 and 8 offers two additional steps, 1500 watts and 2000 watts, during operation in mains mode.

Alternatively, it is possible to use a rotary potentiometer whose power selector is not marked with numbers, but only with "Max" and "Min". During operation in mains mode, the "Max" position then corresponds to 2000 or 1200 watts, respectively, while in battery mode, it corresponds to 600 watts. The "Min" position corresponds to a setting of 300 watts.

What is claimed is:

1. A vacuum cleaner comprising:
- a housing;
- a motor-driven suction fan disposed in the housing;
- a fan motor configured to operate at a rated voltage in a range of 80 and 120 volts during a maximum operation;
- a power supply device configured to provide power supply to the fan motor;
- a rechargeable battery permanently integrated in the housing, the rechargeable battery having a voltage rating between 50 volts and 80 volts; and
- a cord reel permanently integrated in the housing,
- wherein the vacuum cleaner is configured to be alternately operable in a battery mode and a mains mode.

2. The vacuum cleaner as recited in claim 1 wherein the vacuum cleaner comprises a canister vacuum cleaner.

3. The vacuum cleaner as recited in claim 1 wherein the rechargeable-battery is disposed in a lower shell at a bottom of the housing.

4. The vacuum cleaner as recited in claim 3 wherein the lower shell is double-walled and includes stiffening ribs.

5. The vacuum cleaner as recited in claim 3 wherein the rechargeable battery includes a plurality of separate battery cells.

6. The vacuum cleaner as recited in claim 5 wherein the lower shell includes at least one opening configured for removal of the separate battery cells.

7. The vacuum cleaner as recited in claim 3 wherein the lower shell includes at least one opening configured for removal of the rechargeable battery.

8. The vacuum cleaner as recited in claim 1 further comprising a circuit arrangement configured to transform a mains input voltage to an operating voltage between 50 volts and 100 volts.

9. The vacuum cleaner as recited in claim 1 wherein the voltage produced by the rechargeable battery is about 65 volts.

10. The vacuum cleaner as recited in claim 1 wherein the fan is configured to operate with field weakening during operation in the battery mode.

11. The vacuum cleaner as recited in claim 10 wherein the fan motor includes a stator winding including a first and a second coil, the first coil being configured to be completely de-energized so as to weaken the field.

12. The vacuum cleaner as recited in claim 11 wherein during operation in the battery mode, a positive pole is in electrical contact with a brush and a negative pole is in electrical contact with a stator winding so as to energize the fan motor.

13. The vacuum cleaner as recited in claim 1 further comprising a circuit arrangement configured to sense supply of mains voltage, and configured to set a mode of operation to the mains mode when mains voltage is supplied and to the battery mode when no mains voltage is supplied.

14. A method of operating a vacuum cleaner comprising:
- providing a vacuum cleaner including:
  - a housing;
  - a motor-driven suction fan disposed in the housing;
  - a fan motor configured to operate at a rated voltage in a range of 80 and 120 volts during a maximum operation;
  - a power supply device configured to provide power supply to the fan motor; and
  - a rechargeable battery having a voltage rating between 50 volts and 80 volts; and
  - a cord reel permanently integrated in the housing;
- operating the vacuum cleaner in a battery mode at a voltage in a range from 50 volts to 80 volts;
- operating the vacuum cleaner in a mains mode; and
- charging the rechargeable battery during operation in the mains mode.

15. The method as recited in claim 14 wherein the vacuum cleaner includes a circuit arrangement, and further comprising:
- sensing a supply of mains voltage using the circuit arrangement; and
- setting a mode of operation to the mains mode when mains voltage is supplied and to the battery mode when no mains voltage is supplied.

16. The method as recited in claim 14 wherein the vacuum cleaner includes a circuit arrangement, and further comprising limiting, via the circuit arrangement, a maximum selectable, using a power adjustment device, power of the fan motor when operating in the battery mode to less than a maximum selectable power of the fan motor when operating in mains mode.

17. The method as recited in claim 14 further comprising reliably separating the mains mode and battery mode so as to prevent a short-circuit.

18. The method as recited in claim 17 wherein the reliably separating the mains mode and battery mode is performed using a change-over relay.

* * * * *